US005201338A

United States Patent [19]

McKeague

[11] Patent Number: 5,201,338

[45] Date of Patent: Apr. 13, 1993

[54] SYSTEM AND DEVICE FOR FLUSHING WATER MAINS

[75] Inventor: Daniel G. McKeague, St. Louis County, Mo.

[73] Assignee: John C. Kupferle Foundry Company, St. Louis, Mo.

[21] Appl. No.: 795,333

[22] Filed: Nov. 20, 1991

[51] Int. Cl.[5] ..... E03B 7/07; E03B 9/06; B08B 3/04; B08B 9/06

[52] U.S. Cl. ..... 137/238; 73/863.86; 134/166 C; 137/272; 137/296; 137/315

[58] Field of Search ..... 137/238, 240, 272, 296, 137/301, 302, 315; 251/291; 73/863.81, 863.86; 134/166 R, 166 C

[56] References Cited

U.S. PATENT DOCUMENTS

| | | | |
|---|---|---|---|
| 182,938 | 10/1876 | Kupferle et al. . | |
| 246,489 | 8/1981 | Fuller | 137/296 |
| 270,354 | 1/1883 | White | 137/287 |
| 310,853 | 1/1885 | Ryle | 137/296 |
| 726,369 | 4/1903 | Sullivan | 137/272 |
| 1,086,841 | 2/1914 | Mueller | 137/296 |
| 1,316,799 | 9/1919 | Menige | 137/302 |
| 2,033,880 | 3/1936 | Coles et al. | 137/296 |
| 2,249,848 | 7/1941 | O'Brein | 137/272 |
| 3,185,171 | 5/1965 | Mueller | 137/283 |
| 3,439,947 | 4/1969 | Luckenbill et al. | 137/301 |
| 3,532,108 | 10/1970 | Sullivan | 137/296 |
| 3,532,109 | 10/1970 | Smith | 137/296 |
| 3,626,961 | 12/1971 | Quinones | 137/296 |
| 3,752,179 | 3/1971 | Atkins et al. | 137/272 |
| 3,961,642 | 3/1975 | Thomas et al. | 137/272 |
| 3,980,096 | 7/1975 | Ellis et al. | 137/283 |
| 4,284,099 | 8/1981 | Rifat | 137/296 |
| 4,440,190 | 2/1982 | Barbe | 137/272 |
| 4,651,771 | 7/1986 | Borenstein et al. | 137/296 |
| 4,756,479 | 3/1987 | Lazenby, III | 137/302 |
| 4,790,341 | 1/1988 | Laurel | 137/15 |

FOREIGN PATENT DOCUMENTS

| | | | |
|---|---|---|---|
| 59745 | 4/1942 | Denmark | 137/296 |

OTHER PUBLICATIONS

John C. Kupferle Foundary Co. Eclipse product brochure 1991.

Ratnik Industries, Inc. Prod. No. 52 May 20, 1974.

*Primary Examiner*—George L. Walton

*Attorney, Agent, or Firm*—Polster, Lieder, Woodruff & Lucchesi

[57] ABSTRACT

A water distribution system includes flushing hydrants having buried valve assemblies and a removable top stock carried from valve assembly to valve assembly. A vertical marker replaces the top stock when the hydrant is not in use. The buried valve assembly includes a valve urged closed by water pressure and an actuator rod extending through a spider in the top of a vertical barrel. A lock nut on the upper end of the actuator holds the valve closed even if water pressure is lost. The upper end of the vertical barrel includes an internally threaded adapter. The top stock includes a casing which is externally threaded to mate with the adapter and a second rod which is threaded to mate with the actuator rod. The hydrant is assembled by removing the lock nut and screwing the parts together while an operating screw is swung free, then swinging the operating screw into engagement with the second rod. A preferred embodiment permits water samples to be taken from the hydrant. An alternative embodiment provides automatic draining systems to make the hydrant frost proof.

22 Claims, 5 Drawing Sheets

SYSTEM AND DEVICE FOR FLUSHING WATER MAINS

BACKGROUND OF THE INVENTION

This invention relates to water systems and in particular to municipal and rural water systems having mains which dead-end at various parts of the system. The invention relates particularly to a novel system of flushing hydrants for use in such water systems and to valve assemblies and top stocks for use in the system of flushing hydrants. It also relates to a simplified system for sampling water quality.

Maintaining and monitoring water quality is becoming increasingly important to most water companies. In the United States, for example, the Safe Drinking Water Act amendments of 1986 have caused many water companies to pay very close attention to the quality of water they are providing to their customers. Also, these new regulations require more sampling of the water from points out in the distribution system. These samples are taken on a regular basis and then tested.

Maintaining water quality can sometimes be difficult, especially on a dead-end water main. Water which is located at a dead-end water main becomes stagnant. It loses its chlorine and develops a bad taste and odor; it can also lose its clear appearance and become dark and cloudy. When this happens, or when a break occurs in the main which allows contamination such as bacteria, mud and rocks into the main, the water company sends a crew out to "flush" the water main, by opening a device at the end of the main. Commonly, the device at the end of the main is a flushing hydrant or a blow-off.

A traditional flushing hydrant is a factory-made device installed strictly for the purpose of maintaining water quality. FIG. 1 shows a typical prior art flushing hydrant FH attached to a water main M. The flushing hydrant FH includes a shoe S containing a main valve, a vertical barrel VB containing a valve actuating rod, and a hydrant H permanently attached to the vertical barrel. The hydrant H includes an outlet O and a control nut C for opening the main valve.

A flushing hydrant differs in several respects from a fire hydrant. A fire hydrant is designed with the single purpose of producing maximum possible water flow to fight a fire; it is usually situated in-line with a water main. A flushing hydrant provides means for flushing stale water from a main end. A flushing hydrant is smaller and less expensive than a fire hydrant. A fire hydrant requires a four-inch valve or larger, whereas a flushing hydrant uses a one-inch to three-inch valve, preferably a 1.5"–2.5" valve. A fire hydrant must be available for use in the shortest possible time; a flushing hydrant need not be so easily or quickly operated. An example of a commercially available flushing hydrant is the Eclipse No. 2 post hydrant sold by the John C. Kupferle Foundry Company of St. Louis, Mo.

A blow-off is usually an assembly of factory-made parts, including a buried valve and various sections of piping. Lazenby, U.S. Pat. No. 4,756,479 illustrates a blow-off. FIG. 2 shows a typical prior art blow off BO. The blow off BO includes a ball valve BV attached between a main M and a vertical barrel or pipe BV' having an outlet O' at its upper end. The ball valve BV is controlled by a control C, accessible through a removable lid at ground level.

Although the individual parts of a blow-off are generally less expensive than a flushing hydrant, the blow-off must be assembled in the field, at considerable additional cost and with a considerably greater risk of improper installation.

Flushing hydrants and blow-offs are subject to a number of problems. Water theft, especially in rural areas, is a major problem for most water purveyors; a flushing hydrant or a blow-off is an easy target. Traffic and farm implements tend to hit flushing hydrants and blow-offs because they are sometimes hidden by weeds and brush. This tends to damage both the vehicle and the device. Even if the hydrants or blow-offs survive the collision, the installation is usually damaged and leaks occur. This requires excavating and re-installation of the hydrant or blow-off. In freezing climates, it is important for a hydrant to drain its barrel to a level below the frost-line; when a freeze comes, no water is in the barrel to freeze. During the construction process and in case of a main break, small debris may be left in water mains. This debris will then be flushed out of the water main when put under water pressure. It is important that the debris pass through the main valve and out of the hydrant. Moreover, such debris may be caught in the hydrant valve and damage the valve when it is forced shut.

The sampling requirements for a modern water supply system dictate taking samples from various points in the system on a regular schedule. However, provision of a self-draining feature makes the hydrant subject to incursions of ground water into the hydrant, thereby making the hydrant unsuitable for sampling water quality. Taking samples at other points in the system, however, may be complicated by lockouts from public and private buildings, freezing, and vandalism. Therefore, the John C. Kupferle Foundry Company has introduced its Eclipse No. 88 sampling station, which provides a locked, vandal-resistant access point for taking water samples. This station is described in Waterworld News, July/August, 1990. Such a sampling station, however, requires an additional installation, and it is generally checked by a different crew from the crew which periodically opens flushing hydrants in the system.

SUMMARY OF THE INVENTION

One of the objects of the present invention is to provide a water distribution system having multiple dead-ends with a system of flushing hydrants at the dead-ends, the system of flushing hydrants being simpler and less expensive than previously known systems.

Another object is to provide such a system in which the flushing hydrants are inoperable when not in use, and which discourages unauthorized use of the hydrant.

Another object is to provide such a system in which the hydrant locations may be highly visible yet are protected from accidental damage.

Another object is to provide such a system in which the hydrants provide easy sampling capability and easy manual freeze protection.

Another object is to provide such a system in which the hydrants may easily be modified to provide automatic freeze protection.

Another object is to provide such a hydrant which passes debris and whose valve is protected from damage caused by overtightening.

Other objects will occur to those skilled in the art in light of the following description and accompanying drawings.

In accordance with one aspect of the present invention, generally stated, a water distribution system is provided including a plurality of main ends and flushing means for the main ends. The flushing means at each main end includes a valve assembly comprising a buried valve shoe attached to the main, a vertical barrel attached to the valve shoe, first coupling means on the vertical barrel, a valve in the valve shoe, and an actuator rod attached to the valve and extending through the vertical barrel. The flushing means further comprises at least one portable flushing hydrant top stock, the flushing hydrant top stock comprising a casing having second coupling means for coupling with the first coupling means on the vertical barrel and means cooperative with the actuator rod to open the valve when the first and second coupling means are coupled.

Preferably, the first coupling means comprises an internally threaded collar at an upper end of the vertical barrel and the second coupling means comprises an external thread on a lower end of the top stock casing.

Because the relatively inexpensive valve assembly is the only part of the device which must be supplied at each location, and one or a few of the relatively expensive top stocks are carried to the valve assemblies as needed, the cost of the system is greatly reduced.

Because the flushing hydrant can not be operated by untrained personnel or in the absence of the top stock and the knowledge of how to use it, the hydrant discourages tampering and water pilferage. A removable lock nut at the top of the actuator rod prevents the valve from opening if water pressure is lost in the main and also further discourages tampering.

At each valve assembly location, when the top stock is not in use, it is replaced by a threaded vertical plastic pipe which acts as a protector and a marker. The plastic pipe is all that extends above grade when the hydrant is not in use. This plastic pipe will break when struck by a vehicle and is very inexpensive to replace. No damage will be done to the vehicle, the hydrant, or the installation.

Preferably, the top stock includes a second rod which is threaded to couple with the actuator rod. Both the actuator rod and the second rod are hollow and an aperture is provided in the actuator rod just above the valve. In a preferred embodiment, no drain is provided, and a tap is provided at the upper end of the second rod for taking samples through the coupled rods. This keeps bacteria and other things which might taint a water sample from entering the hydrant via the drain holes. The same tap may then be used after each use for pumping out standing water in the barrel above the closed valve to give freeze protection.

In an alternative embodiment, a hollow lower end of the actuator rod extends into a blind sleeve having an outlet aperture in its side. When the valve is open, o-rings on the rod prevent flow through the lower rod and flow through the shoe from reaching the outlet aperture. When the valve is closed, water above the valve flows from the upper aperture in the actuator rod to the outlet aperture to drain the barrel.

The valve assembly at each dead-end preferably includes a valve seat having a lower seating surface, the valve stem extending through the valve seat and the valve rising to seat with the seating surface, the valve being moved into engagement with the valve seat solely by the force of water in the system. In the preferred embodiments, the top stock includes reflector means on the second rod responsive to water flowing through the top stock for urging the valve to a closed position. The hydrant top stock includes a gland through which the second rod passes and a push rod engaging an upper end of the second rod for pushing the second rod to open the valve, the push rod being incapable of pulling the second rod to close the valve. The construction of the main valve to be clear of all hydrant parts except the operating rod leaves much room for debris to pass. Also, the valve and valve seat cannot be forced against any caught debris because the operating rod cannot be pulled by the push rod.

Other aspects of the invention will be better understood in light of the following description of the preferred embodiments.

DESCRIPTION OF THE PREFERRED EMBODIMENT

Figure 3:
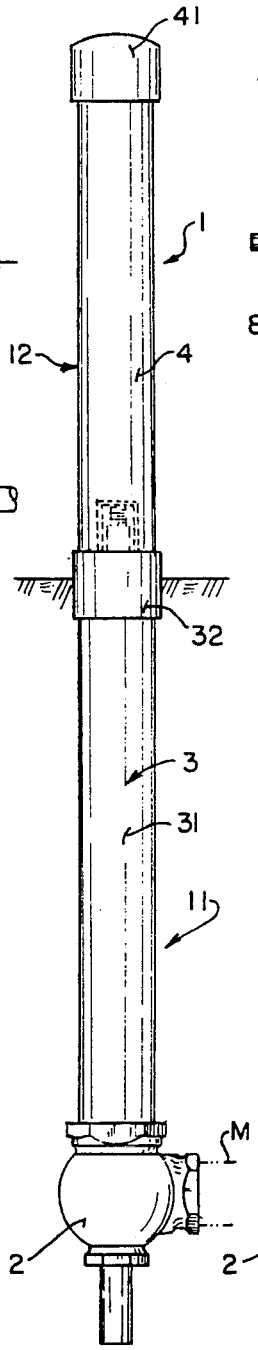
FIG. 3 is a view in front elevation of an illustrative embodiment of flushing hydrant of the present invention attached at a dead-end of a water system, the hydrant being in a non-use configuration.
Figure 4:
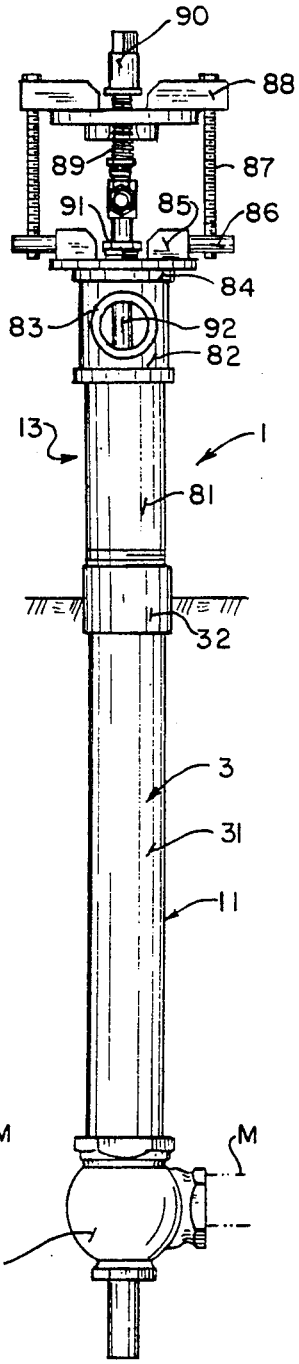
FIG. 4 is a view in front elevation of the flushing hydrant of FIG. 3 in a configuration for flushing the dead-end of the water system.

Referring now to the drawings, FIGS. 3-4 show a preferred embodiment 1 of the flushing hydrant of the present invention, attached to a main M at a dead-end in the main M. It will be understood that a typical municipal or rural water system will include many such hydrants at dead-ends attributable to subdivision cul-de-sacs, rural homes, and the like.

As shown in FIG. 3, when not being used for flushing, the flushing hydrant 1 includes a lower valve assembly 11 and an upper part 12. The lower valve assembly 11 includes as its outer casing a brass bottom or shoe 2 which is threaded onto the main M, a heavy lower plastic vertical barrel 31 threaded into the shoe 2, and an internally threaded steel collar or coupling 32 threaded onto the upper end of the lower vertical barrel 31. The upper part 12 includes a plastic marker 4 which is covered by a plastic cap 41.

The plastic marker 4 is in the form of a vertical plastic pipe which is externally threaded at its lower end to be removably connected to the coupling 32. It preferably stands about 18" to 48" high to be readily visible to equipment operators. It is preferably white or a bright, visible color. When struck by a vehicle or piece of heavy equipment, the marker 4 is designed to break without damage to the lower vertical barrel 31 or coupling 32. The lower vertical barrel 31 and marker 4 are made, illustratively, of schedule 80 PVC pipe.

Figure 6:
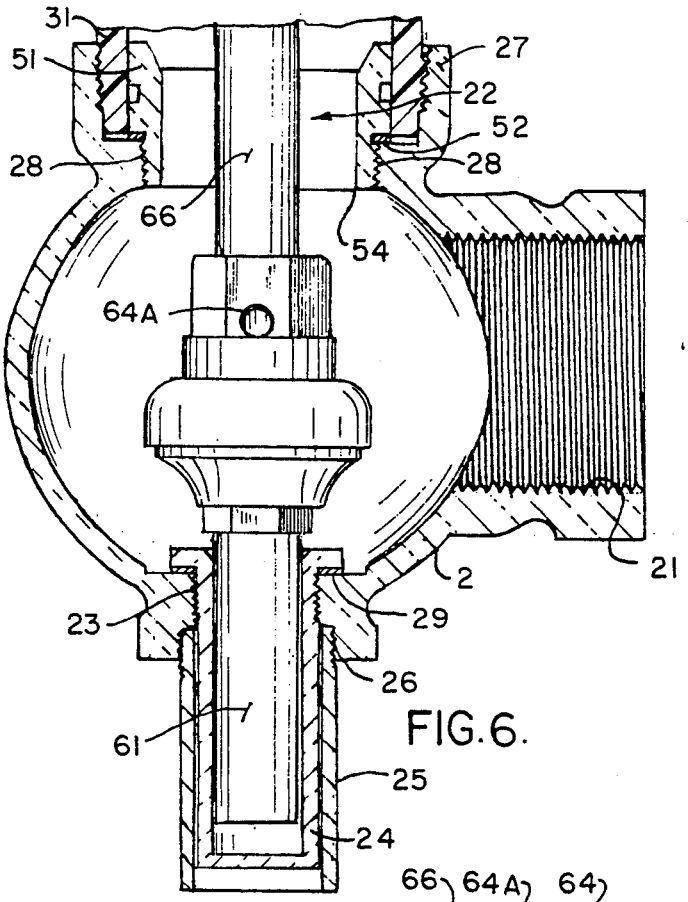
FIG. 6 is a sectional view of the lower end of the flushing hydrant of FIGS. 3–5, showing a main valve open.
Figure 7:
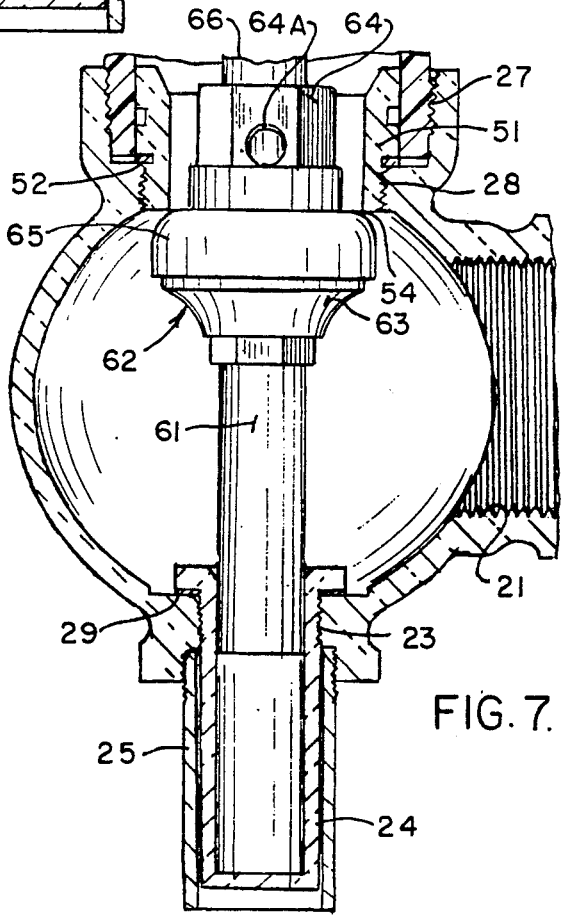
FIG. 7 is a sectional view corresponding to FIG. 6, showing a main valve closed.

As shown in FIGS. 6-7, the shoe 2 includes an internally threaded side inlet 21, an internally threaded upper outlet 22, and an internally threaded lower opening 23. A brass guide tube 24 threaded into the lower opening 23 includes a blind bore having a chamfered opening which forms a guide for a valve rod assembly described hereinafter. A gasket 29 seals the guide tube 24 to the shoe 2. A protective steel sleeve 25 threaded into a boss 26 in the shoe 2 fits loosely around the guide tube 24. The lower end of the lower vertical barrel 31 is threaded into an enlarged boss 27 around the outlet 22, and a 2" valve seat 51 is threaded into a smaller portion 28 of the outlet 22. A gasket 52 seals the valve seat to the shoe 2. A lower annular edge of the valve seat forms a seating surface 54 for a valve part described hereinafter. Standard means, not shown, for unscrewing the valve seat 51 are provided for removing the valve seat and its associated valve from the top of lower vertical barrel 31 for repair.

A valve rod assembly 6 is slidably mounted between the guide tube 24 at the lower end of the shoe 2 and a guide 7 in the form of a spider in the collar 32 at the upper end of lower vertical barrel 31. The guide 7 is described hereinafter.

The valve rod assembly 6 includes a lower solid brass rod 61 which slides loosely in guide tube 24. The upper end of the lower rod 61 is threaded into a valve body 62 which includes a tapped lower base part 63, a tapped upper nut part 64, and intermediate seat rubber 65 which mates with the valve seat surface 54 to close the hydrant 1. The valve rubber 65 is formed of SBR rubber having a durometer of about 90 A. The seat 54 forms a substantially line seal with the domed surface of the valve rubber 65, rather than being bevelled or countoured to fit the shape of the valve rubber 65. An aperture 64A is provided in the upper nut part 64. An actuator rod in the form of a brass tube 66 is threaded into the upper nut part 64 of the valve body 62. The lengths of the brass tube 66 and the lower vertical barrel 31 are chosen to position their tops at or near ground level when the shoe 2 is buried below frost level for a particular locale. The upper end of tube 66 has threaded onto it a hexagonal hollow brass coupling 67. The coupling 67 has an externally threaded nipple 68 threaded into its upper end.

Figure 5:
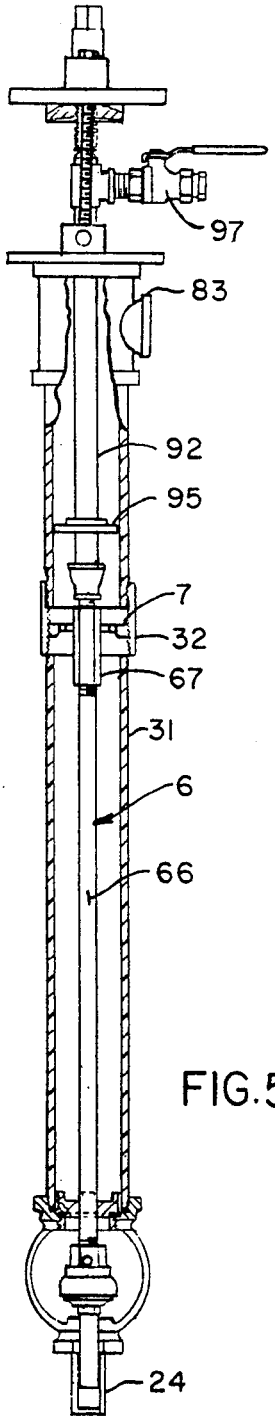
FIG. 5 is a view in side elevation of the flushing hydrant of FIG. 4, partially in axial section and partially cut away.
Figure 9:
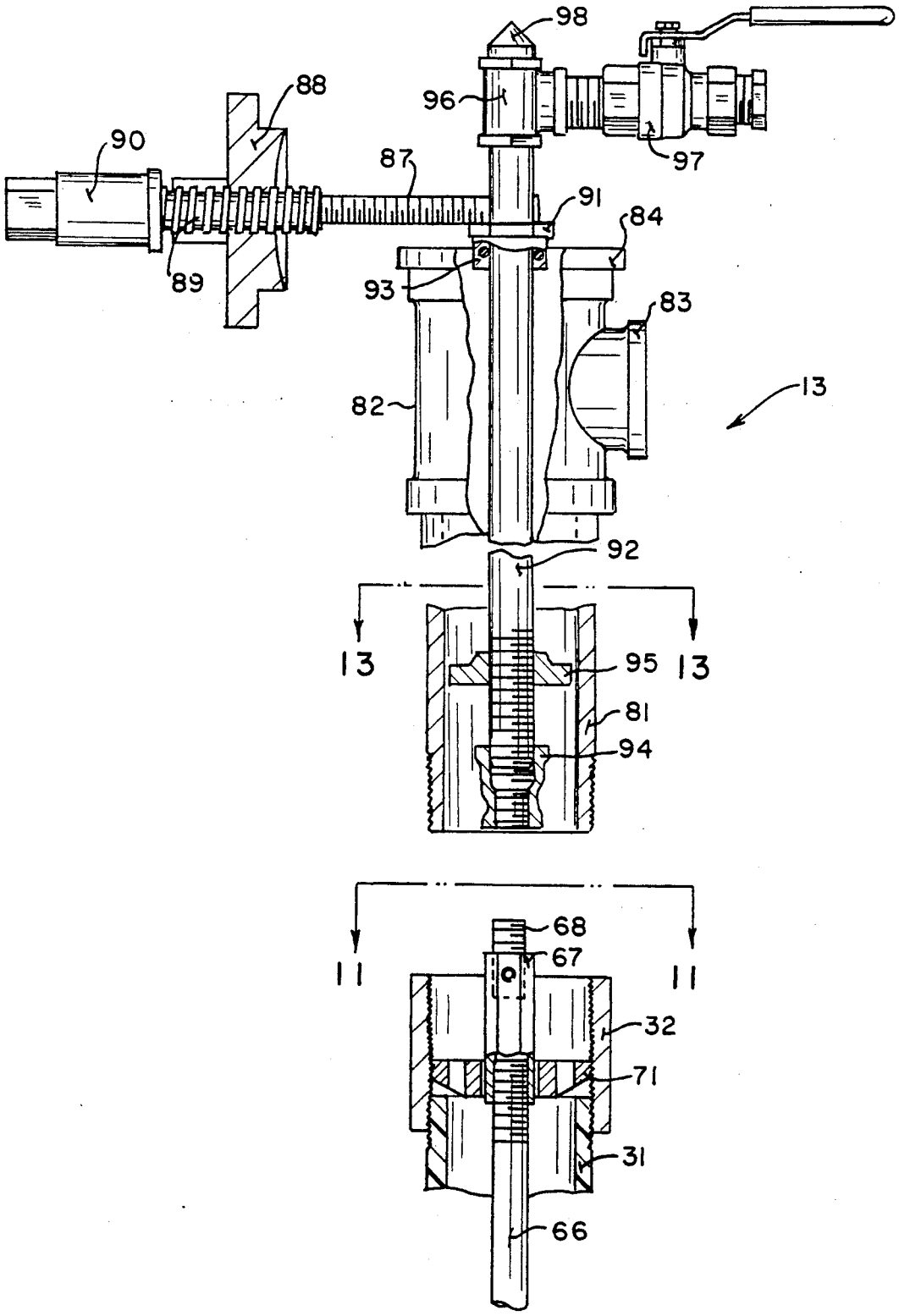
FIG. 9 is an exploded view, partially broken away and partially in cross-section, showing a top stock portion of the hydrant of FIGS. 3–8 ready to be attached to a valve assembly portion of the hydrant.
Figure 8:
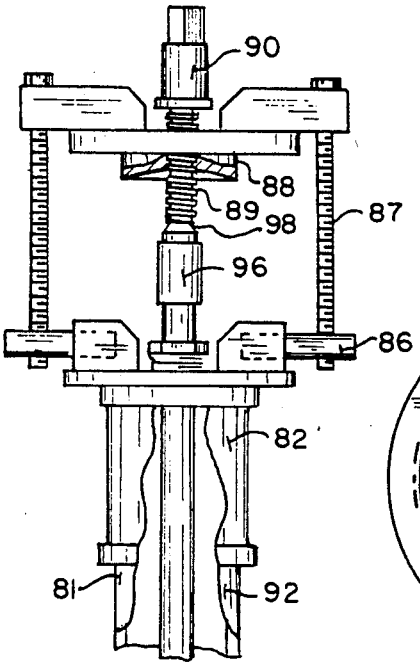
FIG. 8 is a view in rear elevation of a top stock portion of the flush hydrant of FIG. 3–7, partially broken away.
Figure 10:
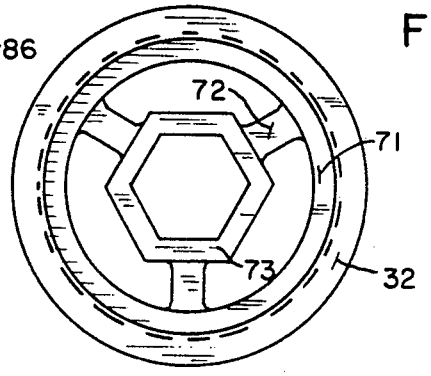
FIG. 10 is a view in top plan of a guide portion of the hydrant of FIGS. 3–9, threaded into a collar portion.
Figure 11:
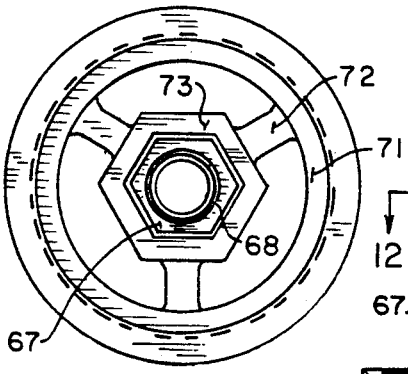
FIG. 11 is a top plan view of the valve assembly portion of the hydrant of FIGS. 3–9, taken along line 11—11 of FIG. 9.
Figure 14:
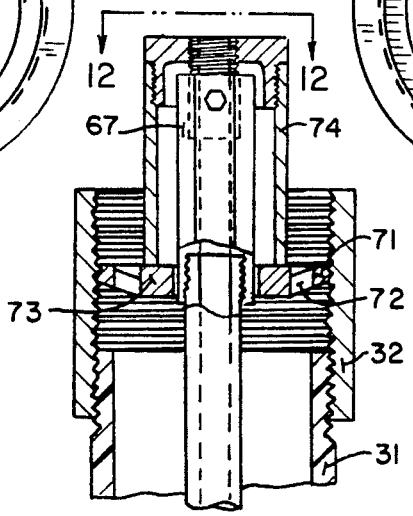
FIG. 14 is a cross-sectional view of an upper end of the valve assembly portion of the hydrant of FIGS. 3–9, showing a lock nut attached to the upper end of a valve rod assembly.

As shown particularly in FIGS. 10 and 14, the guide 7 includes an externally threaded rim 71 which is threaded to the desired depth in the collar 32 and locked. The rim 71 supports through legs 72 a hexagonal slide bearing 73 which forms a guide for the coupling 67, as shown in FIG. 11. When the valve 62 is fully closed, the lower end of the coupling 67 is just held by the guide 7, as shown in FIGS. 9 and 14. When the valve 62 is completely open, the upper end of the coupling 67 is just held by the guide 7, as shown in FIG. 5.

Figure 12:
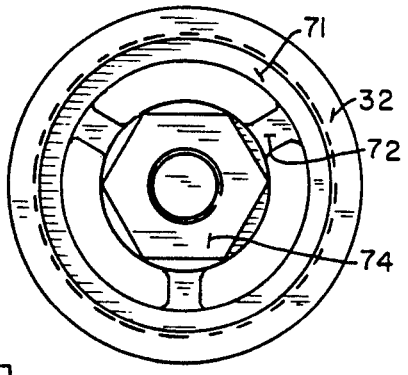
FIG. 12 is a view corresponding to FIG. 11, with a lock nut attached, as indicated by line 12—12 of FIG. 14.

When the flushing hydrant 1 is not in use, a lock nut 74 holds the valve rod assembly 6 in its closed position, as shown in FIGS. 12 and 14. Thus, even if water pressure is lost in the main M, the valve 62 will remain closed. The nut 74 may also be given additional locking means, such as a special external configuration graspable by a special tool, or an ear through which a padlock can be secured to one of the legs 72. In general, however, the hydrant is protected by the marker 4 and by the fact that no easy means are available for opening the valve rod assembly 6 or for connecting a hose to the hydrant if the valve were forced open.

When it is desired to flush a lower valve assembly 11 or to sample water at the location of one of the lower valve assemblies 11, a transportable top stock 13 is brought to it. As shown in FIGS. 4, 5, 8, and 9, the top stock 13 includes a vertical casing 81 in the form of a steel pipe of the same diameter as the pipe 31. The pipe 81 is threaded at its lower end to mate with the threads in the sleeve 32. A steel nozzle section 82 threaded to the upper end of the vertical casing 81 includes a threaded outlet 83 for discharging water from the hydrant 1. An aluminum plate 84 is threaded to the top of the nozzle section 82. The plate 84 carries on its upper face a pair of brass pillow blocks 85 into which are journaled horizontal steel pins 86, which in turn support a pair of vertical bolts 87 which are threaded through the pins 86 for rotation with the pins 86. The bolts 87 are threaded through and support an upper aluminum support structure 88, thereby establishing a fixed but adjustable distance between the upper support structure 88 and pins 86. Threaded through the center of the upper support structure 88 is a threaded brass rod 89 having at its upper end an actuator nut and collar 90 for limiting the depth to which the threaded rod may be tightened. The lower end of the rod is conically concave.

Figure 13:
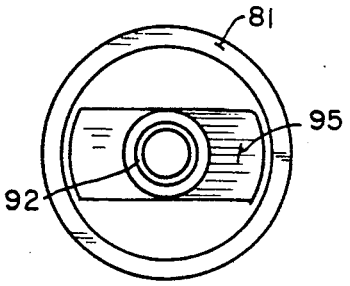
FIG. 13 is a view in cross-section taken along line 13—13 of FIG. 9, showing a water deflector part of the hydrant of FIGS. 3–9.

Slidably and rotatably mounted through a central gland nut 91 in the plate 84 is a hollow brass rod 92. An o-ring 93 seals the joint between gland nut 91 and rod 92. The lower end of the rod 92 carries an adapter 94 for threading onto the stud 68 at the upper end of the lower rod 66. Threaded onto the rod 92 above the adapter is a water reflector 95, as shown particularly in FIGS. 9 and 13. At the upper end of the rod 92 is a "T" 96 to the leg of which is mounted a manually operable tap in the form of a ball valve 97. At the upper end of the "T" 96 is a conical closure cap 98 sized to form a smooth rotational fit with the lower end of the threaded rod 89.

As shown particularly in FIG. 9, the top stock 13 is attached by removing the lock nut 74, then aligning the adapter 94 with the stud 68, and simultaneously aligning the lower end of the pipe 81 with the collar 32. Chamfers on the adapter 94 and collar 32, the alignment of the rod 66 by the guide 7, and alignment of the rod 89 by the water reflector 95 simplify the mating process. As shown in FIG. 9, when the top stock 13 is unattached, the pipe 92 slides to its lowermost position and the upper plate 88 may be swung to a horizontal position. The pipe 81 is threaded into the collar 32 with the aid of the upper plate 88 as a handle, and the adapter 94 of the hollow rod 92 is threaded onto the stud 68 with the aid of the valve 97, which is free to turn because the bolts 87 are swung free.

When both connections have been hand-tightened, the upper plate 88 is swung to a vertical position and the threaded rod 89 is turned until it mates with the conical upper end of hollow rod 92. A wrench is then put on the nut 90 and the valve rod assembly 6 is forced downward against the water main pressure to open the valve 62. The collar on the nut 90 limits the distance the valve rod assembly can be moved downward and prevents the lower valve assembly 63 from bottoming on the guide 24 and bending the actuator rods.

While the valve 62 is open, water flows from the main M to the outlet 83 through the valve seat 51. As shown in FIG. 6, the rod 66 is the only obstruction in the open seat, and debris passes freely. Because the valve 97 is closed, no water flows through the joined hollow rods 66 and 92.

When the water pouring from the outlet 83 has changed from stagnant water to clear water from the circulating portions of the main, the valve 62 is closed by turning the nut 90 to raise the rod 87. Although the threaded rod 87 is not coupled to the upper hollow rod 92 and is thus incapable of lifting it, the pressure of water on the valve 62 and on the water reflector 95 firmly lifts the valve rod assembly 6 until the valve rubber 65 is sealingly seated on the valve seat 54.

Should a rock or other debris become lodged between the valve rubber 65 and the seat 54, water will continue to flow after the threaded rod 87 lifts clear of the top of the upper hollow rod 92. The amount of force placed on the valve and seat in this condition is limited to that imparted by the water in the main. To close the valve, the operator must therefore open it again to allow the debris to clear, then again allow it to clear.

The sampling valve 97 has a dual purpose; it may be used for sampling and for freeze-proofing. In either case, water passes through the aperture 64A into the coupled hollow rods 66 and 92, and out through the valve 97. If the valve 97 is turned 180° from the outlet 83, the sample may be taken without shutting the valve 62. Preferably, however, the valve 62 is allowed to close by loosening the push rod 89, then capping the outlet 83, then reopening the valve 62 sufficiently to take the sample. The sample may be taken directly at the hydrant 1, by the same crew which performed the flushing operation. The samples are conventionally stored in small containers or jars and transported to a laboratory for analysis. The ability to sample at the same time as flushing, without recourse to a separate sampling device, represents a major benefit to a water purveyor.

When any desired samples have been taken and the main valve 62 closed by water pressure, water must be removed from the lower barrel 31 (except in a location not subject to freezing). The column of water in the lower vertical barrel 31 and the casing 81 is pumped out by attaching a pump, such as a standard manual bilge pump, to the outlet of sampling valve 97. The water is drawn through the aperture 64A at the bottom of the lower actuator rod 66 until only a small amount of water remains around the nut 64, well below the freeze line. If preferred, the top stock 13 may be removed while still full of water, and the remaining water pumped through the stud 68.

After the water has been pumped from the lower vertical barrel, the casing 81 and the adapter 94 of the top stock 13 are unscrewed from the lower vertical barrel 31 and the stud 68 respectively. The lock nut 74 is screwed on finger-tight to hold the valve 62 closed in case of loss of water pressure, and the vertical marker pipe 4 is screwed into the collar 32.

Because no springs or moving parts other than the valve rod assembly are required, the preferred embodiment of the present invention is quite rugged. Because the only moving parts can be extracted easily through the lower barrel 32, the device is easy to repair.

Numerous variations in the flushing hydrant and water distribution system of the present invention, within the scope of the appended claims, will occur to those skilled in the art in light of the foregoing disclosure.

Figure 15:
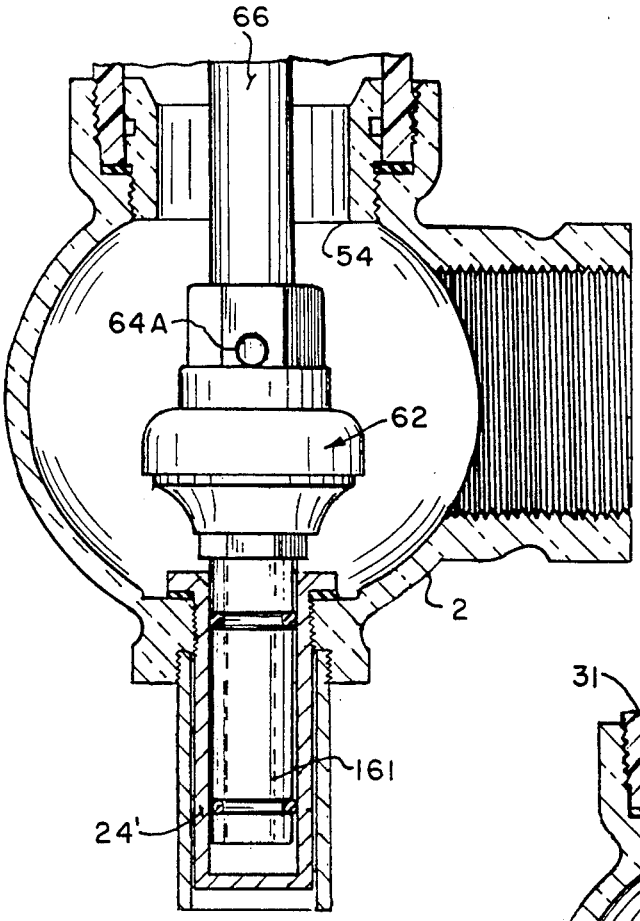
FIG. 15 is a detail, corresponding to FIG. 6, showing a second embodiment of flushing hydrant of the invention.
Figure 16:
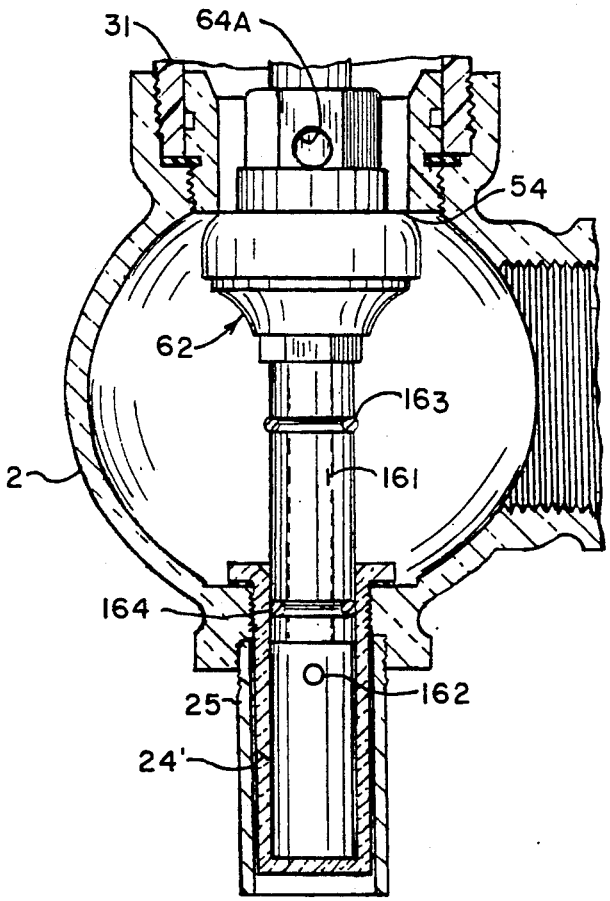
FIG. 16 is a detail, corresponding to FIG. 7, of the embodiment of FIG. 15.

Merely by way of example, the flushing hydrant may be made automatically freeze-proof, as shown in the alternative embodiment of FIGS. 15 and 16. In this embodiment, the solid guide rod 61 is replaced by a hollow guide rod 161, and a drain opening 162 (FIG. 16) is provided in the guide 24'. O-rings 163 and 164 seal the opening 162 from the main M in both the open and the closed positions of the valve rod assembly 6. As shown in FIG. 15, when the 62 is open, the opening 162 communicates only with an annular space between the o-rings 163 and 164, and is isolated from the rest of the system. When the valve rod assembly begins to move up toward its closed position, full main pressure is applied to the hole, blowing out any debris that may be blocking the hole or the bottom of the sleeve 25. When the valve 62 is closed, as shown in FIG. 16, the opening 162 communicates with the aperture 64A through the hollow guide rod 161 and permits water in the vertical barrels 31 and 81 to drain through the opening 162 Although this arrangement is simple to use and guarantees that water will be removed from the lower barrel 31, the existence of the drain opening makes it unsuitable for sampling, because of the possibility of contamination through the drain opening.

Figure 1:
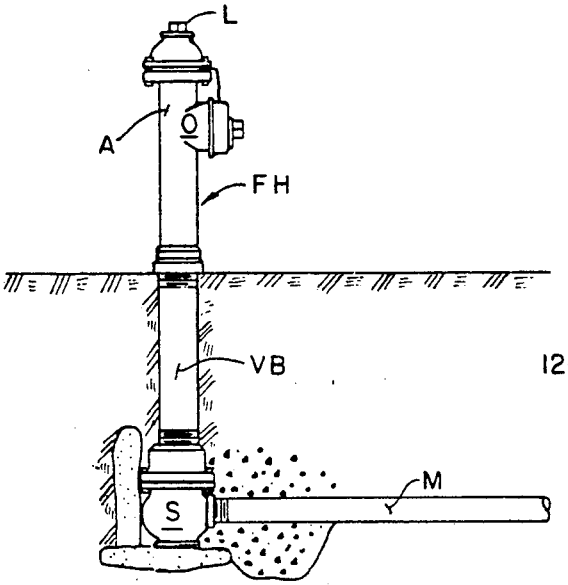
FIG. 1. PRIOR ART.
FIG. 1 is a view in side elevation of a typical prior art flushing hydrant.
Figure 2:
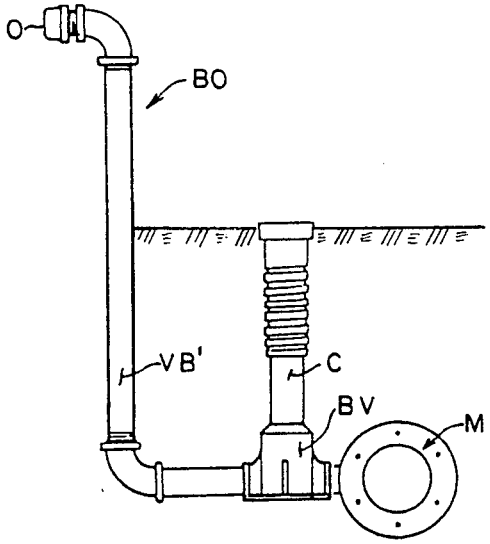
FIG. 2. PRIOR ART.
FIG. 2 is a view in side elevation of a typical prior art blow-off.
Figure 17:
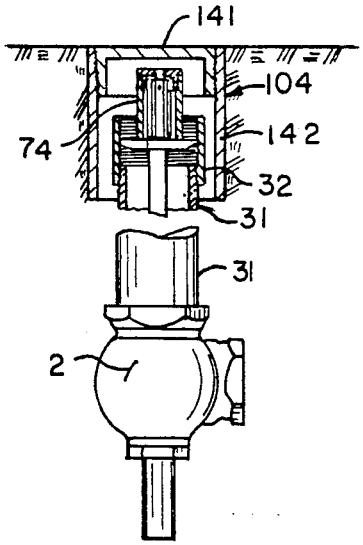
FIG. 17 is a view in front elevation, corresponding to FIG. 3, of the lower valve assembly part of a third embodiment of flushing hydrant of the invention.

As shown in FIG. 17, the upper end of the lower valve assembly 11 may be positioned below grade level, and a cover 104 placed around and over it. The cover 104 takes the place of the marker pipe 4. The cover 104 includes a cover section 141 flush with grade level and a pipe section 142 which extends down around the lower barrel 31 a sufficient distance to preclude heaving and to protect the upper end of the barrel 31. Alternatively, a valve box such as the one at the top of control C in FIG. 2 may be placed over the lower valve assembly 11.

These variations are merely illustrative.

I claim:

1. In a water distribution system including a plurality of main ends and flushing means for said main ends, the improvement wherein said flushing means comprises (a) at each said main end a buried pipe, a valve shoe attached to said buried pipe, a valve in the valve shoe, a vertical barrel attached to the valve shoe, first coupling means on said vertical barrel, and an actuator rod attached to the valve and extending through the vertical barrel, (b) at least one portable flushing hydrant top stock, said flushing hydrant top stock comprising a casing having an outlet and second coupling means for selectively coupling said casing with said first coupling means on said vertical barrel, and means cooperative with said actuator rod to open said vale when said first and second coupling means are coupled, for passing water past said valve and through said outlet for flushing said distribution system, and (c) cover means for protecting said vertical barrel when said top stock is not coupled to said vertical barrel.

2. The system of claim 1 wherein said first coupling means comprises an internally threaded collar at an upper end of said vertical barrel and said second coupling means comprises an external thread on a lower end of said top stock casing.

3. The system of claim 1 wherein said valve shoe includes a valve seat having a lower seating surface, said valve stem extending through said valve seat and said valve rising to seat with said seating surface.

4. The system of claim 3 wherein said valve is moved into engagement with said valve seat solely by the force of water in said system.

5. The system of claim 4 wherein said means in said top stock cooperative with said actuator rod includes a second rod, and coupling means on said second rod for forming a coupling with said actuator rod.

6. The system of claim 5 further including reflector means on said second rod responsive to water flowing through said top stock for urging said valve to a closed position.

7. The system of claim 5 wherein said hydrant top stock includes a gland through which said second rod passes and a push rod engaging an upper end of said second rod for pushing said second rod to open said valve, said push rod being incapable of pulling said second rod to close said valve.

8. The system of claim 1 further including lock means associated with said actuator rod for locking said valve closed when said top stock is not coupled to said vertical barrel.

9. The system of claim 1 wherein said cover means comprises vertical marker means, said vertical marker means including third coupling means for coupling with said first coupling means, to couple said vertical marker means with said vertical barrel when said hydrant top stock is not attached to said vertical barrel.

10. In a water distribution system including a plurality of main ends and flushing means for said main ends, the improvement wherein said flushing means comprise at each said main end a buried pipe; a valve shoe attached to said buried pipe; a valve in the valve shoe; a vertical barrel attached to the valve shoe; an outlet in the barrel, the valve controlling flow of water from the main to the outlet; a hollow actuator rod attached to the valve and extending through the vertical barrel; and aperture means in a lower end of said hollow actuator rod for passing water samples from a lower end of the hollow actuator rod to an upper end of the actuator rod through the actuator rod independent of the outlet in the barrel.

11. The improvement of claim 10 wherein the flushing means further comprises at least one portable flushing hydrant top stock, said flushing hydrant top stock comprising a casing having coupling means for coupling with said vertical barrel and means cooperative with said actuator rod to open said valve when said first and second coupling means are coupled.

12. A flushing hydrant assembly comprising (a) a valve hose, a valve seat in the valve shoe, and a valve movable mounted in the valve shoe for movement into closure with the valve seat and movement away from the valve seat, (b) a vertical barrel attached to the valve shoe, an actuator rod attached to the valve and extending through the vertical barrel, guide means at an upper end of the barrel for guiding the actuator rod, the actuator rod being freely slidable in the guide means for opening and closing the valve, and locking means for selectively locking the actuator rod to hold the valve in its closed position, and (c) a selectively removable flushing hydrant top stock, said flushing hydrant top stock comprising an outlet means, coupling means for coupling said top stock with said vertical barrel and means cooperative with said actuator rod to selectively force said actuator rod to slide and open said valve when said coupling means is coupled with said barrel and said locking means is released, thereby permitting flow through the valve seat, through the vertical barrel, and through the outlet means in the top stock for flushing a source attached to the hydrant assembly.

13. A flushing hydrant assembly comprising a valve shoe, a valve seat in the valve shoe, a valve movably mounted in the valve shoe for upward movement into closure with the valve seat and downward movement away from the valve seat, a vertical barrel attached to the valve shoe, an actuator rod attached to the valve and extending through the vertical barrel, guide means at an upper end of the barrel for guiding the actuator rod, locking means for selectively locking the actuator rod to hold the valve in its closed position, and a selectively removable flushing hydrant top stock, said flushing hydrant top stock comprising an outlet means, coupling means for coupling said top stock with said vertical barrel and means cooperative with said actuator rod to open said valve when said coupling means is coupled with said barrel and said locking means is released, thereby permitting flow through the valve seat, through the vertical barrel, and through the outlet means in the top stock for flushing a source attached to the hydrant assembly, said means cooperative with said actuator rod comprising a second rod in said top stock, and reflector means on said second rod responsive to water flowing through said top stock for urging said valve to a closed position.

14. The flushing hydrant assembly of claim 13 wherein said top stock includes no means for mechanically raising said actuator rod, said actuator rod being closed entirely by water in the hydrant.

15. A lower valve assembly adapted for use with a selectively removable flushing hydrant top stock, the flushing hydrant top stock comprising an outlet, coupling means for coupling the top stock with said lower valve assembly and actuation means, said valve assembly comprising a valve shoe, a valve seat in the valve shoe, a valve movably mounted in the valve shoe for upward movement into closure with the valve seat and downward movement away from the valve seat, a vertical barrel attached to the valve shoe, second coupling means on the vertical barrel for attaching the vertical barrel to the top stock, an actuator rod attached to the valve and extending through the vertical barrel, guide means at an upper end of the barrel for guiding the actuator rod, the actuator rod being freely slidable in the guide means for opening and closing the valve, and locking means for selectively locking the actuator rod to hold the valve in its closed position when no top stock is on said valve assembly, the actuator rod being cooperative with the actuation means in the top stock to selectively open said valve when said first and second coupling means are coupled and said locking means is released, thereby permitting flow through the valve seat, through the vertical barrel, and through the outlet means in the top stock for flushing a source attached to the hydrant assembly.

16. The valve assembly of claim 14 wherein the locking means comprise a locking nut cooperative with the actuator rod and the guide means.

17. A flushing top stock assembly for selective attachment to a valve assembly, the valve assembly including a valve, a threaded barrel and a hollow actuator rod for actuating the valve, said top stock comprising a casing threaded for engagement with the threaded barrel, the casing including an outlet, a second hollow rod, second outlet means at an upper end of the second hollow rod, and means on a lower end of the second hollow rod for making fluid-tight engagement with the actuator rod, said second hollow rod being movable to open said valve to permit flow of fluid through the valve to said outlet in said casing of said top stock, the hollow actuator rod and said second hollow rod forming a conduit through which fluid samples can be drawn through said second outlet means independent of said outlet in said casing of said top stock.

18. The top stock assembly of claim 17 further including a guide on said casing for slidably supporting said second rod, and an actuator means for forcing said second rod downward when said casing is attached to the threaded barrel.

19. The top stock assembly of claim 18 wherein said means on a lower end of the hollow rod comprise a thread, and wherein said actuator means is selectively movable into engagement with said hollow rod and out of engagement with said hollow rod, the hollow rod being rotatable for engagement with the actuator rod when and only when said actuator means is moved out of engagement with said hollow rod.

20. A method of cleaning at least a selected one of a plurality of dead-ends of a water distribution system comprising a step of installing a lower valve assembly in each of the dead-ends, each valve assembly comprising a valve shoe, a valve in the valve shoe, a vertical barrel attached to the valve shoe, first coupling means on said vertical barrel, and an actuator rod attached to the valve and extending through the vertical barrel, a step of placing a cover on each lower valve assembly to protect the valve assembly when not in use, a step of removing at least a part of the cover from a selected valve assembly, a step of attaching a flushing hydrant top stock to the valve assembly, the flushing hydrant top stock comprising a casing having an outlet and second coupling means for selectively coupling the casing with the first coupling means on the vertical barrel, and means cooperative with the actuator rod to open the valve when the first and second coupling means are coupled, a step of operating the actuator rod for flowing water through the valve and top stock to flush stagnant water from the dead end, and a step of removing the top stock and replacing the cover.

21. The method of claim 20 including a further step, between the step of flowing water through the top stock and the step of removing the top stock, of taking a sample of water for analysis.

22. In a water distribution system including a plurality of main ends and flushing means for said main ends, the improvement wherein said flushing means comprises (a) at each said main end a buried pipe, a valve shoe attached to said buried pipe, a valve in the valve shoe, a vertical barrel attached to the valve shoe, first coupling means on said vertical barrel, a hollow actuator rod attached to the valve and extending through the vertical barrel, guide means at an upper end of the barrel for guiding the actuator rod, and locking means for selectively locking the actuator rod to hold the valve in its closed position, (b) at least one portable flushing hydrant top stock, said flushing hydrant top stock comprising a casing having second coupling means for coupling with said first coupling means on said vertical barrel and an outlet, a hollow rod, and means on a lower end of the hollow rod for making fluid-tight engagement with the actuator rod to open said valve when said first and second coupling means are coupled for passing water from said valve through said outlet for flushing said distribution system, said casing and said hollow rod being attachable to and removable from said vertical barrel and actuator as a single unit, the hollow actuator rod in the vertical barrel and the hollow rod in the top stock forming a passageway for passing water samples from a lower end of the hollow actuator rod to an upper end of the hollow rod independent of said outlet, and (c) cover means for replacing said top stock and protecting said vertical barrel when said top stock is not coupled to said vertical barrel.

* * * * *

UNITED STATES PATENT AND TRADEMARK OFFICE

CERTIFICATE OF CORRECTION

PATENT NO. : 5,201,338

DATED : April 13, 1993

INVENTOR(S) : Daniel G. McKeague

It is certified that error appears in the above-identified patent and that said Letters Patent is hereby corrected as shown below:

Claim 12, column 10, line 11 reads: "(a) a valve hose", should read, -- (a) a valve shoe --

Signed and Sealed this

Twenty-second Day of March, 1994

*Attest:*

*Attesting Officer*

BRUCE LEHMAN

*Commissioner of Patents and Trademarks*